US009850726B2

(12) United States Patent
Gandikota et al.

(10) Patent No.: US 9,850,726 B2
(45) Date of Patent: Dec. 26, 2017

(54) EXPANDABLE OPEN-HOLE ANCHOR

(75) Inventors: Varadaraju Gandikota, Cypress, TX (US); Larry A. Kendziora, Needville, TX (US); Richard Lee Giroux, Cypress, TX (US)

(73) Assignee: WEATHERFORD TECHNOLOGY HOLDINGS, LLC, Houston, TX (US)

( * ) Notice: Subject to any disclaimer, the term of this patent is extended or adjusted under 35 U.S.C. 154(b) by 1721 days.

(21) Appl. No.: 13/095,803

(22) Filed: Apr. 27, 2011

(65) Prior Publication Data

US 2012/0273236 A1 Nov. 1, 2012

(51) Int. Cl.
*E21B 23/01* (2006.01)
*E21B 43/10* (2006.01)

(52) U.S. Cl.
CPC ..... *E21B 23/01* (2013.01); *E21B 43/103* (2013.01)

(58) Field of Classification Search
CPC ..... E21B 23/01; E21B 43/103; E21B 43/10; E21B 23/02; E21B 43/105; E21B 43/106; E21B 17/1028; E21B 17/1021; E21B 33/1291; E21B 33/1292; E21B 33/1293; E21B 29/00; E21B 43/24; E21B 49/00; E21B 23/00
USPC ..... 166/382, 206, 207, 213, 216, 217
See application file for complete search history.

(56) References Cited

U.S. PATENT DOCUMENTS 5,695,008 A 12/1997 Bertet et al.
6,457,532 B1 10/2002 Simpson
6,860,329 B1 3/2005 Oosterling
7,121,351 B2 10/2006 Luke et al.
7,152,684 B2 12/2006 Harrall et al.
7,172,024 B2 2/2007 Cook et al.
7,255,177 B2 8/2007 Duggan et al.
7,367,389 B2 5/2008 Duggan et al.
7,383,889 B2 6/2008 Ring et al.
7,395,857 B2 7/2008 Hillis
7,497,255 B2 3/2009 Filippov et al.
(Continued)

FOREIGN PATENT DOCUMENTS

GB 2406593 A 4/2005
GB 2487669 A 8/2012
(Continued)

OTHER PUBLICATIONS

Invitation to Pay Addiotnal Fees and, Where Applicable, Protest Fee; International Application No. PCT/US2012/035304; dated Aug. 22, 2012.

(Continued)

*Primary Examiner* — Wei Wang
(74) *Attorney, Agent, or Firm* — Patterson + Sheridan, LLP

(57) ABSTRACT

The present invention generally relates to an apparatus and method for expanding an anchoring device in a borehole. In one aspect, an anchoring device is provided. The anchoring device includes an expandable tubular. The anchoring device further includes a plurality of bands disposed on an outer surface of the expandable tubular. Each band is attached to the tubular at a first connection point and a second connection point, wherein each band is configured to bow radially outward as the expandable tubular shortens in length in response to the expansion of the tubular. In a further aspect, a method of attaching an anchoring device in a borehole is provided.

17 Claims, 8 Drawing Sheets

(56) References Cited

U.S. PATENT DOCUMENTS

| | | | | |
|---|---|---|---|---|
| 7,543,639 | B2 | 6/2009 | Emerson | |
| 7,779,923 | B2 | 8/2010 | Holland et al. | |
| 2002/0157831 | A1* | 10/2002 | Kurlenya et al. | 166/302 |
| 2004/0055758 | A1 | 3/2004 | Brezinski et al. | |
| 2004/0065445 | A1 | 4/2004 | Abercrombie Simpson et al. | |
| 2007/0068671 | A1* | 3/2007 | Lohbeck | 166/207 |
| 2008/0156499 | A1 | 7/2008 | Giroux et al. | |
| 2009/0266560 | A1 | 10/2009 | Ring et al. | |
| 2011/0067880 | A1 | 3/2011 | Adamek | |

FOREIGN PATENT DOCUMENTS

| | | | |
|---|---|---|---|
| WO | 2005/031115 | A1 | 4/2005 |
| WO | 2006/012530 | A1 | 2/2006 |

OTHER PUBLICATIONS

Internation Search Report and Written Opinion; International Application No. PCT/US2012/035304; dated Aug. 13, 2012.

EPO Search Report for European Application No. 12720337.0, dated Aug. 18, 2014.

Australian Patent Examination Report dated Mar. 19, 2015, for Australian Application No. 2012249597.

* cited by examiner

EXPANDABLE OPEN-HOLE ANCHOR

BACKGROUND OF THE INVENTION

Field of the Invention

The present invention relates to wellbore completion. More particularly, the invention relates to an apparatus and method for expanding an anchor in a borehole.

Description of the Related Art

Expandable technology enables a smaller diameter tubular to pass through a larger diameter tubular, and thereafter be expanded to a larger diameter. In this respect, expandable technology permits the formation of a tubular string having a substantially constant inner diameter. When an expandable tubular is run into a borehole, it must be anchored within the borehole at the desired depth to prevent movement of the expandable tubular during the expansion process. Anchoring the expandable tubular within the borehole allows expansion of the length of the expandable tubular in the borehole. During the anchoring operation, an expander tool is typically pushed or pulled through an anchor of the expandable tubular to expand the anchor into contact with the surrounding borehole. The anchor must provide adequate frictional engagement between the expandable tubular and the inner diameter of the borehole to stabilize the expandable tubular against longitudinal axial movement within the borehole during the expansion process of the expandable tubular.

The expandable tubular used to isolate the area of interest is often run into the borehole after previous strings of casing are already set within the borehole. The expandable tubular for isolating the area of interest must be run through the inner diameter of the previous strings of casing to reach the portion of the open-hole borehole slated for isolation, which is located below the previously set strings of casing. Accordingly, the outer diameter of the anchor and the expandable tubular must be smaller than all previous casing strings lining the borehole in order to run through the casing to the depth at which the open-hole borehole exists.

Additionally, once the expandable tubular reaches the open-hole portion of the borehole below the previously run casing, the diameter of the open-hole portion of the borehole is often larger than the inner diameter of the casing liner. After being placed at a desired location, to hold the expandable tubular in place within the open-hole portion of the borehole before initiating the expansion process, the anchor must have a large enough outer diameter to sufficiently fix the expandable tubular at a position within the open-hole borehole before the expansion process begins.

There is a need for an open-hole anchor to support an expandable tubular used to isolate an area of interest within a borehole prior to initiating and during the expansion of the expandable tubular. There is a need for an open-hole anchor which is small enough to run through the previous casing liner in the borehole, capable of expanding to a large enough diameter to frictionally engage the inner diameter of the open-hole borehole below the casing liner, and capable of holding the expandable tubular in position axially and rotationally during the expansion of the length of the expandable tubular.

SUMMARY OF THE INVENTION

The present invention generally relates to an apparatus and method for expanding an anchoring device in a borehole. In one aspect, an anchoring device is provided. The anchoring device includes an expandable tubular. The anchoring device further includes a plurality of bands disposed on an outer surface of the expandable tubular. Each band is attached to the tubular at a first connection point and a second connection point, wherein each band is configured to bow radially outward as the expandable tubular shortens in length in response to the expansion of the tubular.

In a further aspect, a method of attaching an anchoring device in a borehole is provided. The method includes the step of positioning the anchoring device in the borehole, the anchoring device having a tubular and a plurality of bands disposed on an outer surface of the tubular. The method further includes the step of reducing the axial length of the tubular by expanding the tubular radially outward, wherein the reduction of axial length of the tubular causes the bands to bow radially outward into contact with the borehole.

In a further aspect, an anchoring device is provided. The anchoring device includes a tubular. The anchoring device further includes a first band attached to an outer surface of the tubular at a first connection point and a second connection point. Additionally, the anchoring device includes a second band attached to the outer surface of the tubular at a third connection point and a fourth connection point, wherein the first band bows to a first distance and the second band bows to a second distance when the axial length of the tubular is reduced due to expansion of the tubular and wherein the first band is disposed on top of a portion of the second band.

In another aspect, an anchoring device is provided. The anchoring device includes a tubular. The anchoring device further includes a first band attached to an outer surface of the tubular at a first connection point and a second connection point, wherein the first connection point is a releasable connection that is configured to release the connection between an end portion of the first band and the tubular. The anchoring device also includes a second band attached to the outer surface of the tubular at a third connection point and a fourth connection point, wherein the first connection point releases the end portion of the first band and the second band bows radially outward when the axial length of the tubular is reduced due to expansion of the tubular.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

The present invention generally relates to an apparatus and method for expanding an anchoring device in a borehole. The anchor will be described herein in relation to an open hole. It is to be understood, however, that the anchor may also be used inside of a cased borehole without departing from principles of the present invention. To better understand the novelty of the anchoring device of the present invention and the methods of use thereof, reference is hereafter made to the accompanying drawings.

FIGS. 1A-1D illustrate an expansion operation of an open-hole anchor 100 (anchoring device) in a borehole 10. The open-hole anchor 100 of the present invention is lowered into the borehole 10 attached to a running tool 25. The running tool 25 in FIGS. 1A-1D is shown for illustrative purposes. Other running tools may be used to expand the open-hole anchor 100 without departing from principles of the present invention.

Figures 1A, 1B, 1C, 1D:
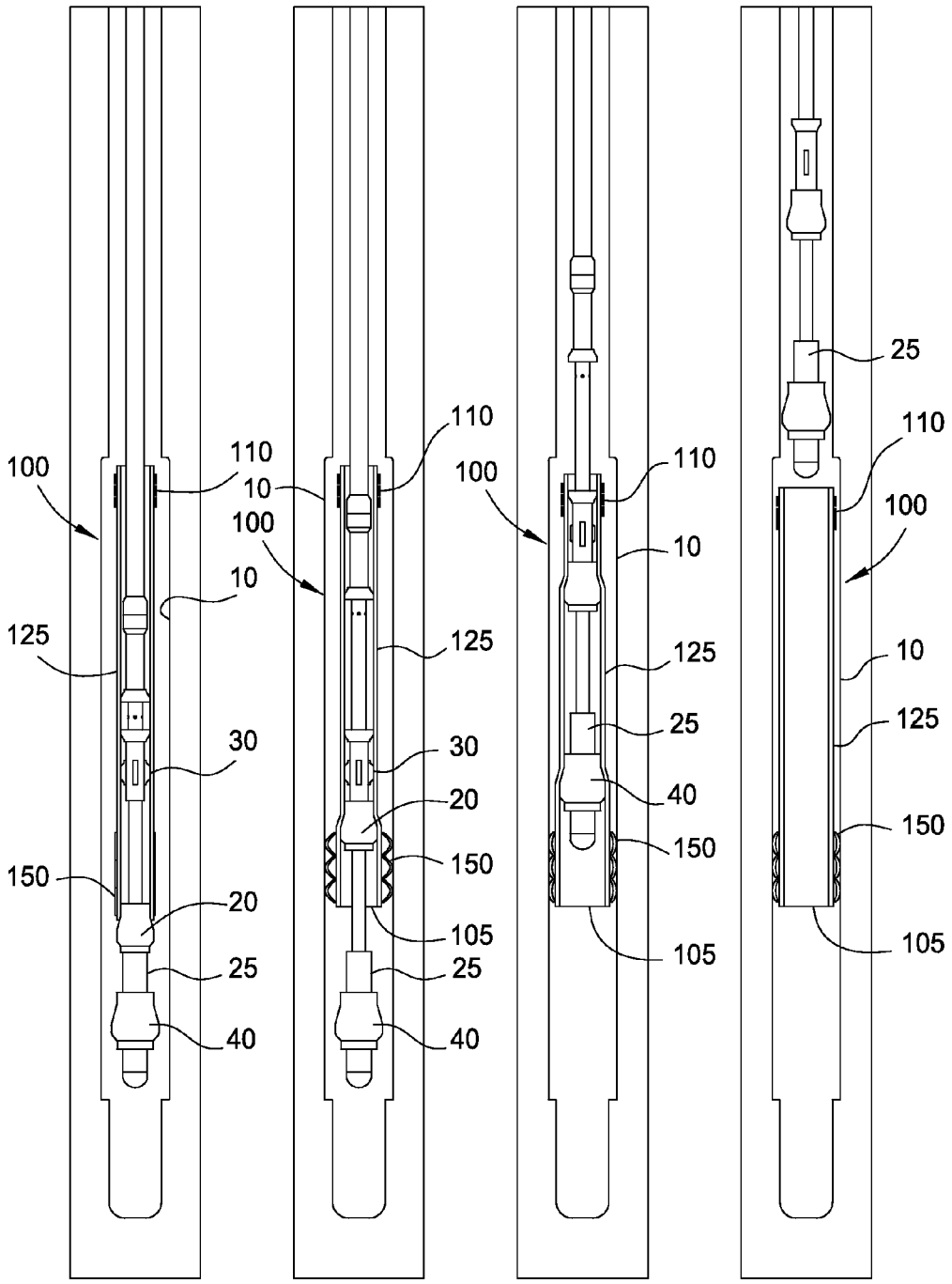
FIGS. 1A-1D are views illustrating an expansion operation of an open-hole anchor in a borehole.

FIG. 1A illustrates the placement of the open-hole anchor 100 adjacent an under-reamed portion of the borehole 10. The open-hole anchor 100 is connected to the running tool 25 by a releasable engagement device 30, such as a latch, collet, slips, thread, shear member or any other suitable mechanism. The open-hole anchor 100 includes an anchor portion 150 and a seal portion 110 disposed around a tubular 125. The anchor portion 150 is positioned between the engagement device 30 (i.e., fixed point) and an end 105 (i.e., free point) of the tubular 125. FIG. 1B illustrates a first cone 20 expanding the tubular 125 adjacent the anchor portion 150. The first cone 20 is configured to move relative to the engagement device 30 by a hydraulic or mechanical moving device. As the first cone 20 expands the tubular 125, the length between the end 105 of the tubular 125 and the engagement device 30 changes from a first length to a second shorter length, which causes the anchor portion 150 to activate. In other words, the tubular 125 becomes axially shorter as the tubular 125 is expanded radially. The reduction in the length of the tubular 125 occurs between the fixed end (engagement device 30) and the free end 105.

FIG. 1C illustrates an optional second cone 40 further expanding the open-hole anchor 100. After the open-hole anchor 100 is attached to the borehole 10 by the anchor portion 150, the engagement device 30 is released and the running tool 25 is pulled upward to expand (or further expand) the tubular 125 of the open-hole anchor 100 by using the first cone 20 and the second cone 40. FIG. 1D illustrates the removal of the running tool 25 after expansion of the open-hole anchor 100.

Figure 2A:
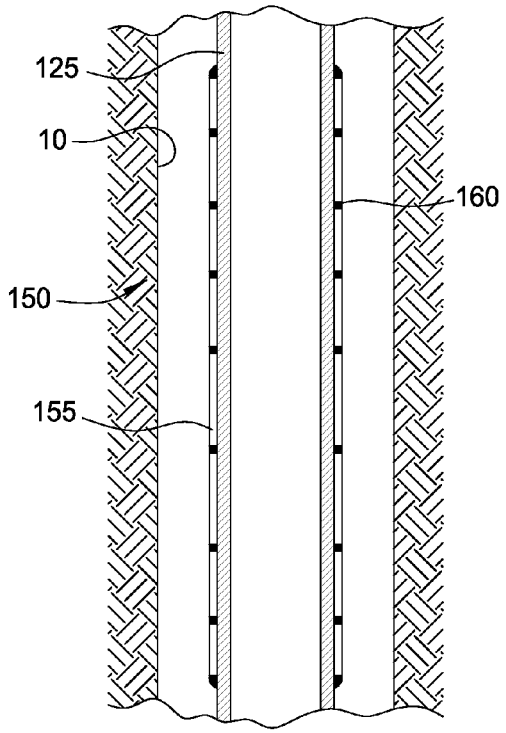
FIGS. 2A and 3A are views illustrating an anchor portion prior to expansion of the open-hole anchor.
Figure 2B:
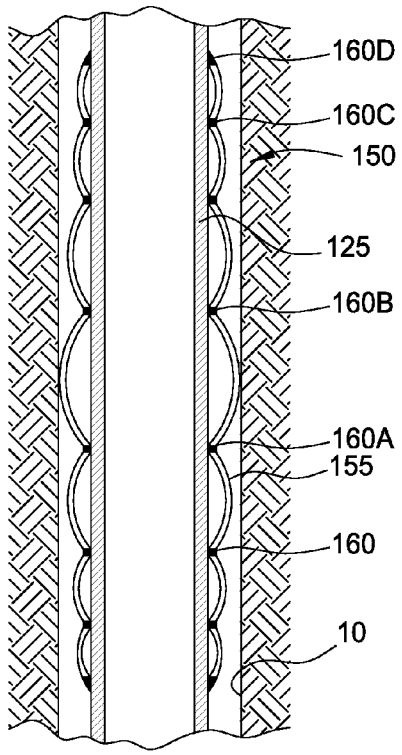
FIGS. 2B and 3B are views illustrating the anchor portion after expansion of the open-hole anchor.
Figure 3A:
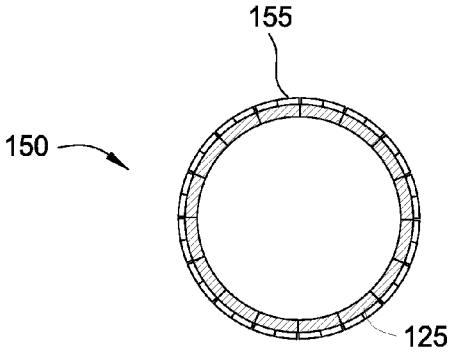
Figure 3B:
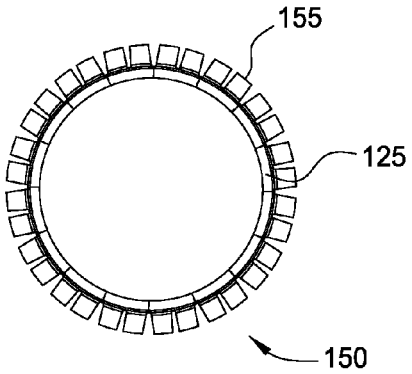

FIGS. 2A and 3A are views illustrating the anchor portion 150 prior to expansion of the open-hole anchor 100, and FIGS. 2B and 3B are views illustrating the anchor portion 150 after expansion of the open-hole anchor 100. As shown, bands 155 are circumferentially spaced around the tubular 125. The bands 155 are made from thin strips of flexible material, such as metal or composite. The bands 155 may be a rectangle, a square, a circle or any geometric shape. The bands 155 are attached to the tubular at connection points 160 along the longitudinal axis of the tubular 125. The connection points 160 may be made by welding, gluing or another connection method known in the art. The bands 155 also include a central section that is not attached to the tubular 125. As shown in FIGS. 2A and 3A, the bands 155 are in a substantially linear arrangement prior to expansion. The bands 155 are configured to buckle as the length of the tubular 125 moves from the first length to the second shorter length due to the radial expansion of the tubular 125. In other words, as the length of the tubular 125 reduces, the length between the connection points 160 also reduces, which causes the bands 155 to buckle and bow (or bend) radially outward. Further, the bands 155 are configured to engage the irregularity of the borehole 10. For instance, if the anchor 100 is positioned in a portion of the borehole 10 that includes an irregular wall, then several bands 155 bow outward into the irregular shaped wall portion and other bands 155 bow outward into the regular shaped wall portion. In other words, the bands 155 conform to the shape of the wall of the borehole 10.

The distance between the connection points 160 define the length of the bands 155. The length of the bands 155 may be used to define the outer diameter of the anchor portion 150. For instance, as shown in FIG. 2B, the largest outer diameter of the anchor portion 150 is defined between connection point 160A and connection point 160B, which has the band with the longest length. The smallest outer diameter of the anchor portion 150 is defined between connection points 160C and 160D, which has the band with the shortest length. Thus, there is a proportional relationship between the length of the band 155 and the outer diameter of the band 155 after buckling occurs due to the expansion of the tubular 125.

Figure 4:
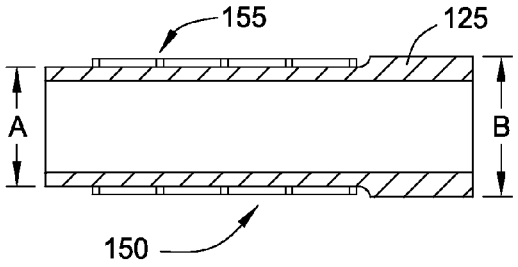
FIG. 4 is a view illustrating bands of the anchor portion disposed on a portion of a tubular.

FIG. 4 illustrates the bands 155 of the anchor portion 150 disposed on a portion of the tubular 125. The tubular 125 has an outer diameter B and a reduced outer diameter A. In the embodiment shown, the bands 155 are located on a portion of the tubular 125 that has the reduced outer diameter A. One benefit of having a reduced outer diameter is that the open-hole anchor 100 may have substantially the same outer diameter by the anchor portion 150 and the portion of the tubular 125 adjacent the anchor portion 150, which may allow the open-hole anchor 100 to move through tight areas of the borehole 10. Another benefit of having a reduced outer diameter is that the force required to expand the tubular 125 of the reduced outer diameter A will be less than the force required to expand a tubular with a larger diameter. Another benefit of having a reduced outer diameter is that the bands 155 are substantially protected against knocks and abrasion when running the anchor 100 into the borehole 10. In other embodiments, the bands may be disposed on a portion of the tubular that has not been reduced or an upset portion (or enlarged portion) relative to other portions of the tubular.

Figure 5:
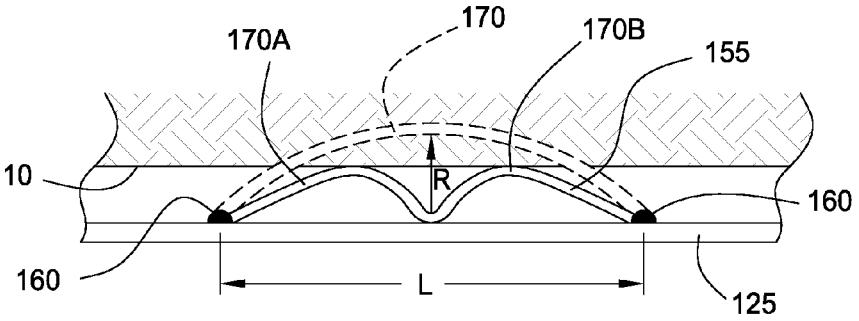
FIG. 5 is a view illustrating the band of the anchor portion having multiple contact points with the borehole.

FIG. 5 illustrates the band 155 of the anchor portion 150 having multiple contact points with the borehole 10. The band 155 may be configured to have a single contact point 170 or multiple contacts points 170A, 170B with the borehole 10. The number of contact points is determined by the length L of the band 155 (e.g., the connection points 160). Generally, the longer the length L, the greater amount of contact points. As discussed herein, the outer diameter of the band 155 is proportional to the length of the band 155. To put it another way, the radius R of the band 155 (i.e., growth) after buckling is directly related to the length L of the band 155. Thus, the number of contact points with the borehole 10 can be determined based upon the length L of the band 155. Typically, the more contact points between the band 155 and the borehole 10, the stronger the anchoring relationship between the anchor portion 150 and the borehole 10. FIG. 5 shows two contact points between the band 155 and the borehole 10, however, there may be any number of contact points without departing from principles of the present invention. Other factors that may affect the radius R and/or the contact points of the band 155 are the radial clearance between the borehole 10 and the tubular 125, the amount of shrinkage of the tubular 125, the thickness of the band 155, the stiffness (and/or the strength) of the material of the band 155 and the characteristics of the borehole 10. Further, the band 155 (after buckling) may have a symmetrical form as shown or may have an asymmetrical form.

Figure 6:
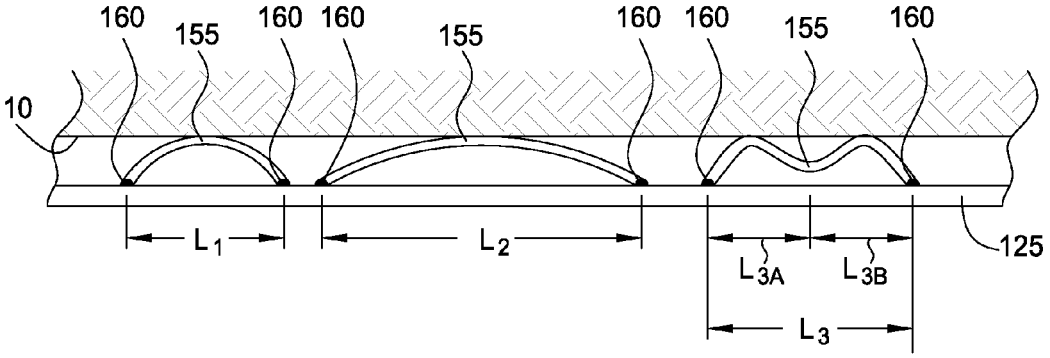
FIG. 6 is a view illustrating different lengths of the band.

FIG. 6 is a view illustrating different lengths of the band 155. As set forth herein, the length L1, L2, L3 of the band 155 is proportional to the outer diameter of the band 155 after buckling occurs due to the expansion of the tubular 125. The length L1, L2, L3 of the band 155 is also inversely proportional to the strength of the anchor (e.g., band 155). For instance, the band 155 with length L1 is a stronger anchor than the band 155 with the length L2. The reason the band 155 with length L1 is a stronger anchor is because the band 155 with length L1 is stiffer or more rigid than the band 155 with the length L2. The band 155 that is stiff has a greater collapse resistance and greater load-bearing capability and thus is a stronger anchor. The band 155 with length L3 illustrates a self-sustaining buckle arrangement in which the length L3 is divided into two short lengths L3A, L3B. In essence, the band 155 with length L3 is divided into two short length bands which are rigid. In sum, the band 155 with length L1 is the strongest anchor, the band 155 with length L3 is the next strongest and the band 155 with length L2 is the weakest of the anchors shown in FIG. 6.

Figure 7:
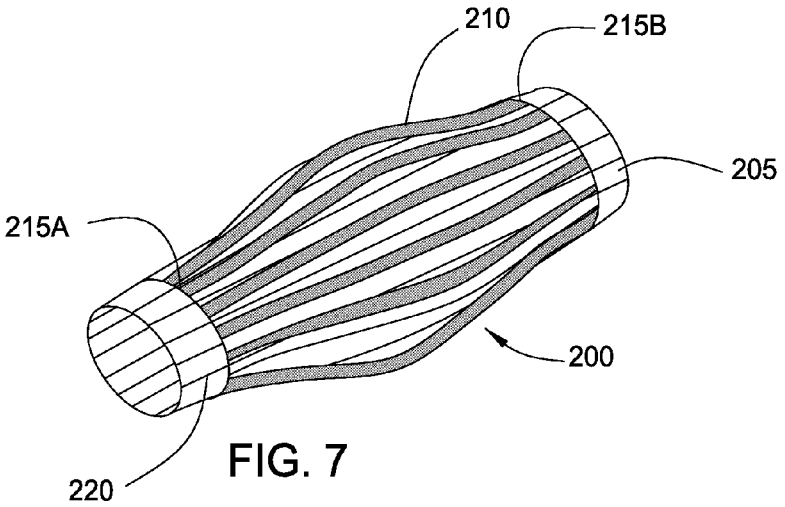
FIG. 7 is a view illustrating an anchor with bands bowed radially outward.

FIG. 7 is a view illustrating an anchor 200 with bands 210 bowed radially outward due to buckling. Each band 210 is connected to a tubular 205 at connection points 215A, 215B. As the tubular 205 is expanded, the bands 210 buckle and bow radially outward. In one embodiment, the tubular 205 may include grooves 220 formed on an outer surface of the tubular 205. The grooves 220 may be used to reduce the required force necessary to expand the tubular 205. In another embodiment, the tubular 205 is a screen mesh and the bands 210 are configured to anchor the screen mesh in the borehole.

Figure 8:
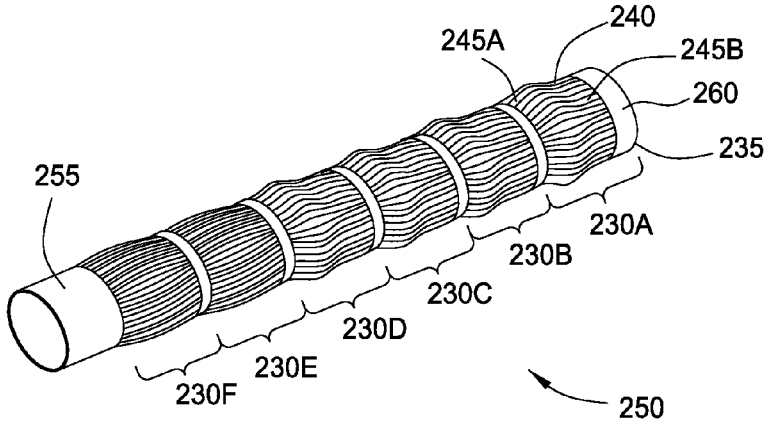
FIG. 8 is a view of an anchor having multiple anchor portions.

FIG. 8 is a view of an anchor 250 having multiple anchor portions 230A-230F. Each anchor portion 230A-230F includes bands 240. Each band 240 is attached to a tubular 235 at connection points 245A, 245B. The anchor portions 230A-230F are located between a fixed end 255 and a free end 260. As the tubular 235 is radially expanded, the length of the tubular 235 is reduced between the fixed end 255 and the free end 260, and thus the anchor portions 230A-230F bow radially outward. As shown, the amount of expansion that occurs in each anchor portion 230A-230F decreases the further away the anchor portion is from the free end 260. In other words, anchor portion 230A bows radially outward further than anchor portion 230F.

Figure 9A:
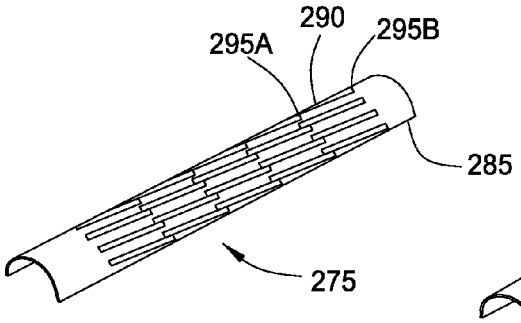
FIG. 9A is a view illustrating an anchor prior to expansion.
Figure 9B:
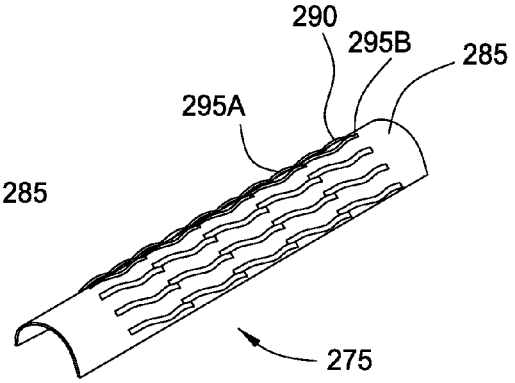
FIG. 9B is a view illustrating the anchor portion after expansion.

FIG. 9A is a view illustrating an anchor 275 prior to expansion, and FIG. 9B is a view illustrating the anchor portion 275 after expansion. As shown, the anchor 275 includes bands 290. Each band 290 is attached to a tubular 285 at connection points 295A, 295B. The bands 290 are disposed on the tubular 285 at an angle relative to a longitudinal axis of the tubular 285. In one embodiment, the band 290 is offset at an angle of 10 degrees relative to a longitudinal axis of the tubular 285. As shown in FIG. 9B, the bands 290 are configured to buckle and bow radially outward as the tubular 285 is expanded.

Figure 10A:
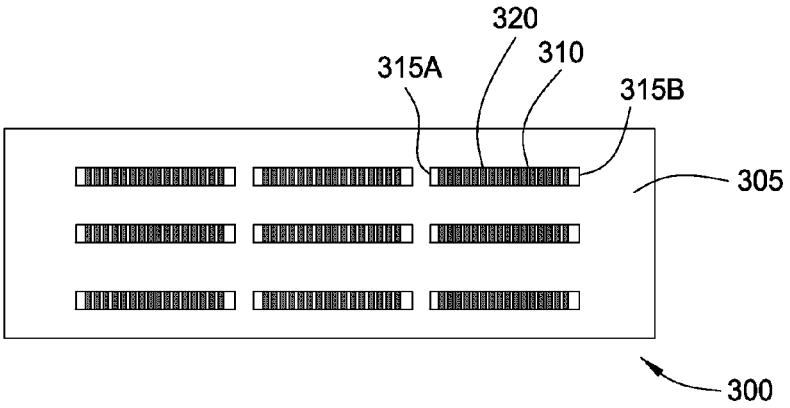
FIG. 10A is a view illustrating an anchor prior to expansion.
Figure 10B:
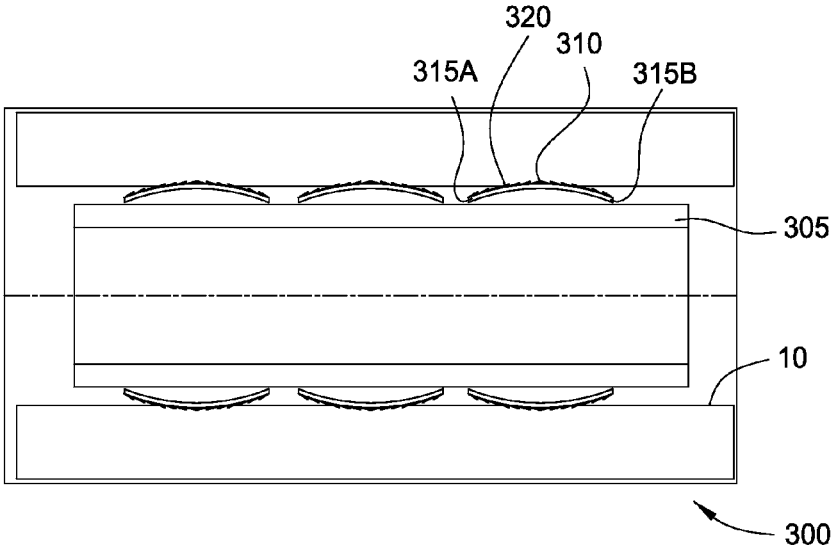
FIG. 10B is a view illustrating the anchor portion expanded into contact with the borehole.

FIG. 10A is a view illustrating an anchor 300 prior to expansion, and FIG. 10B is a view illustrating the anchor portion 300 expanded into contact with the borehole 10. As shown, the anchor 300 includes bands 310. Each band 310 includes grip members 320 on an outer surface of the band 310. The grip members 320 are configured to grip the borehole 10 upon expansion of the band 310. The grip members 320 may be abrasive coating, tungsten carbide inserts, knurled edges or another friction enhancing method known in the art. Each band 310 is attached to a tubular 305 at connection points 315A, 315B. As shown in FIG. 10B, the bands 310 are configured to buckle and bow radially outward into contact with the borehole 10 as the tubular 305 is expanded.

Figure 11:
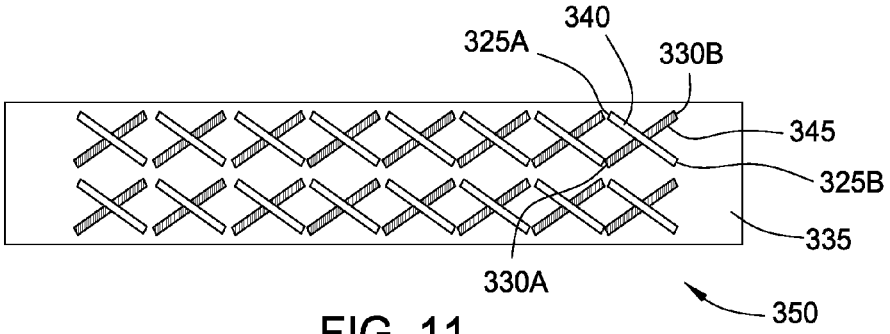
FIG. 11 is a view illustrating an anchor with dual bands.

FIG. 11 is a view illustrating an anchor 350 with dual bands. As shown, the anchor 350 includes bands 340, 345. Each band 340 is attached to a tubular 335 at connection points 325A, 325B, and each band 345 is attached to the tubular 335 at connection points 330A, 330B. As illustrated, the band 340 is disposed on top of band 345 such that the bands 340, 345 make an "X" configuration. Similar to other embodiments, the bands 340, 345 are configured to buckle and bow radially outward as the tubular 335 is expanded.

Figure 11A:
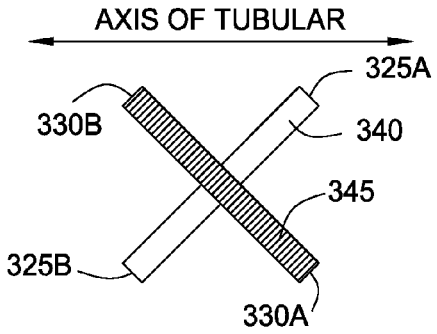
FIGS. 11A-11D illustrate different configurations of the dual bands.

FIGS. 11A-11D illustrate different configurations of the bands 340, 345 shown in FIG. 11. It should be understood, however, that the bands 340, 345 are not limited to the configurations illustrated in FIG. 11A-11D. Rather, other configurations may be devised without departing from principles of the present invention. FIG. 11A illustrates a configuration of the bands 340, 345 in which the band 345 is disposed on top of the band 340. As such, the band 345 may limit the amount the band 340 bows radially outward. For instance, the band 345 may cause the band 340 to be configured as the band 155 shown in FIG. 5 (or FIG. 6 illustrated by $L_3$) in which the band 340 includes multiple contact points. Alternatively, the band 340 may be used to apply a radial force on the band 345 to enhance the amount the band 345 bows radially outward and thus increase the engagement between the anchor and the surrounding borehole. The bands 340, 345 may be made of different material or the bands 340, 345 may have different thickness which may affect the amount the bands 340, 345 bow radially outward.

Figure 11B:
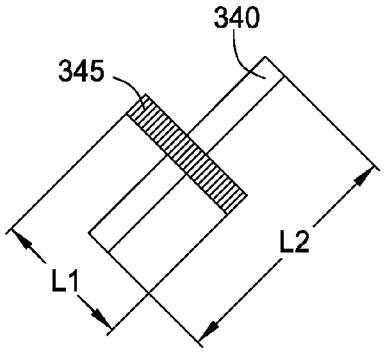

As shown in FIG. 11B, the lengths of the bands 340, 345 may be different. For instance, the band 345 may have a length L1 and the band 340 may have a length L2. In the embodiment illustrated, the length L1 is shorter than the length L2. As set forth herein, the length of the band is related to the amount the band will bow due to shrinkage in the tubular. Thus, the band 345 may not bow as much due to the length L1. Additionally, the band 345 is disposed on top of the band 340, which will limit the amount the band 340 bows radially outward or cause the band 340 to be configured as the band 155 shown in FIG. 5 (or FIG. 6 under $L_3$) in which the band 340 includes multiple contact points. Alternatively, the length of the band 340 may be selected to cause the band 340 to apply a radial force on the band 345 to enhance the amount the band 345 bows radially outward and thus increase the engagement between the anchor and the surrounding borehole. In other embodiments, the band 345 is longer than the band 340, which may allow the band 345 to bow out further than the band 340.

Figure 11C:
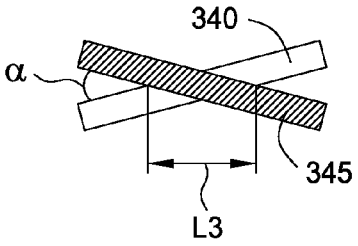

FIG. 11C illustrates the bands 340, 345 having an overlap length L3. The band 345 may be disposed on top of the band 340 at an angle α. The overlap length L3 is increased as the angle α is decreased. For instance, the angle α may be equal to or slightly greater than 0 degrees to have a substantially complete overlap of the bands 345, 340. The opposite holds true: the overlap length L3 is decreased as the angle α is increased. For instance, the angle α may be equal to or slightly greater (or slightly less) than 90 degrees to have minimal overlap of the bands 345, 340. The overlap length L3 of the band 345 may be used to control the amount the band 340 bows radially outward.

Figure 11D:
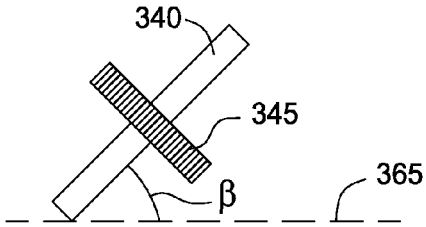

FIG. 11D illustrates the bands 340, 345 disposed at an angle β relative to a longitudinal axis 365 of the tubular. As set forth herein, the shrinkage of the tubular that occurs during the expansion operation is typically along the longitudinal axis 365 of the tubular. Thus, the angle β of the bands 340, 345 relative to the longitudinal axis 365 will affect the amount of expansion of the bands 340, 345. For instance, if the angle β is close to 0 degrees, then the band 340 will be substantially in line with the longitudinal axis 365 and thus experience a large percentage of the shrinkage of the tubular and bow radially outward. At the same time, the band 345 will be substantially perpendicular to the longitudinal axis 365 of the tubular and thus experience a small percentage of the shrinkage of the tubular, which may limit the amount the band 345 bows radially outward. If the angle β is close to 90 degrees, then the band 340 will be substantially perpendicular to the longitudinal axis 365 and thus experience a small percentage of the shrinkage of the tubular, which may limit the amount the band 340 will bow outward. At the same time, the band 345 will be substantially in line with the longitudinal axis 365 and thus experience a large percentage of the shrinkage of the tubular and bow radially outward. The amount the bands 340,345 bow radially outward may be controlled by a combination of length as described in FIG. 11B, amount of overlap as described in FIG. 11C and the angle relative to the longitudinal axis of the tubular as described in FIG. 11D.

Figure 12:
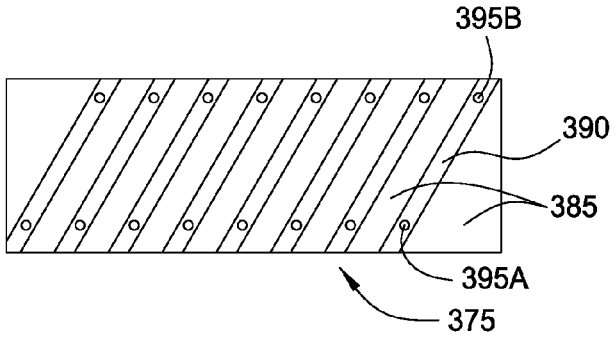
FIG. 12 is a view illustrating an anchor with a spiral band.

FIG. 12 is a view illustrating an anchor 375 with a spiral band 390. As shown, the anchor 375 includes band 390 that is attached to the tubular 385 in a spiral manner. The band 390 may be one continuous piece or several individual pieces. The band 390 may include any number of connection points 395A, 395B. Similar to other embodiments, the spiral band 390 is configured to buckle and bow radially outward as the tubular 385 is expanded.

Figure 13A:
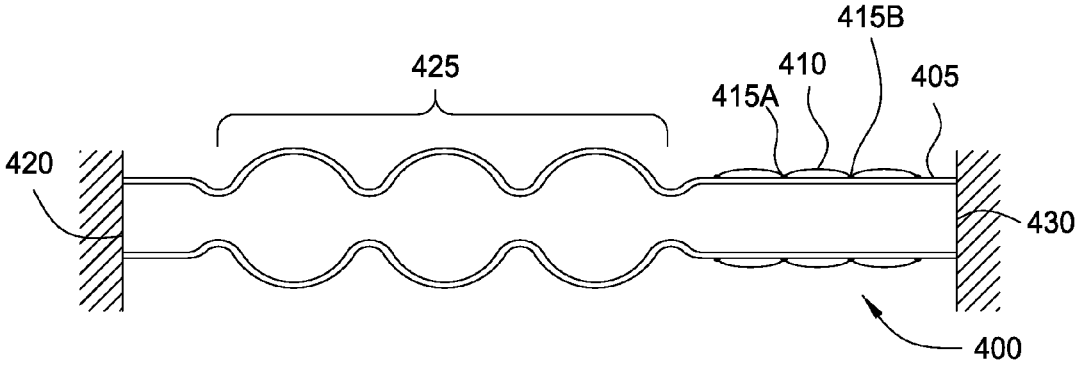
FIG. 13A is a view illustrating an anchor prior to expansion.
Figure 13B:
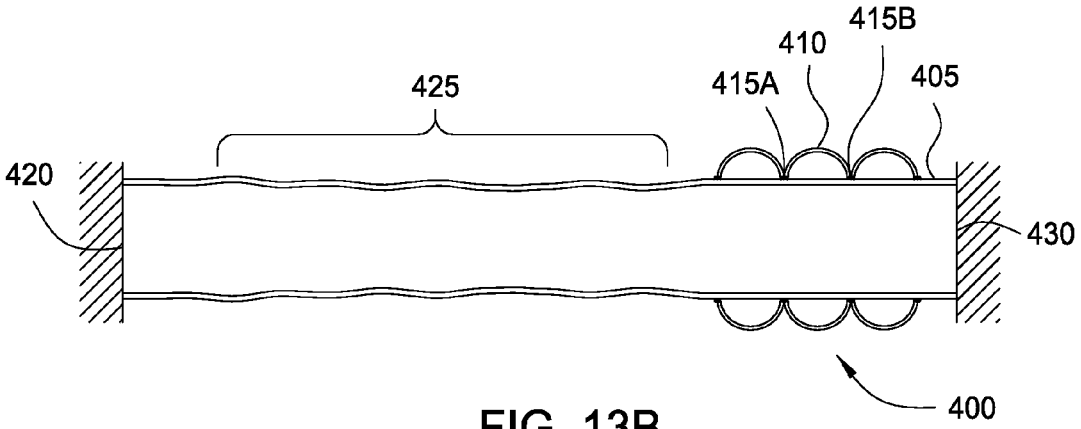
FIG. 13B is a view illustrating the anchor after expansion.

FIG. 13A is a view illustrating an anchor 400 prior to expansion, and FIG. 13B is a view illustrating the anchor 400 after expansion. The anchor 400 may be used when the anchor 400 has a fixed point at each end. In this arrangement, an expansion portion 425 may be used to allow for shrinkage in the tubular 405. More specifically, the tubular 405 has a first fixed point 420 and a second fixed point 430. The first fixed point 420 may be the releasable engagement device (see FIG. 1A), and the second fixed point 430 may be due to differential sticking of the tubular 405 in the borehole or held by another releasable engagement device. As shown, the anchor 400 includes bands 410. Each band 410 is attached to a tubular 405 at connection points 415A, 415B. The anchor 400 also includes the expansion portion 425 that is configured to expand along a longitudinal axis of the tubular 405 as the tubular 405 is radially expanded. The expansion portion 425 may be bellows (as shown) or a slip joint. As the tubular 405 is expanded, the expansion portion 425 elongates along the longitudinal axis of the tubular 405, which causes the bands 410 to buckle and bow radially outward.

Figure 14:
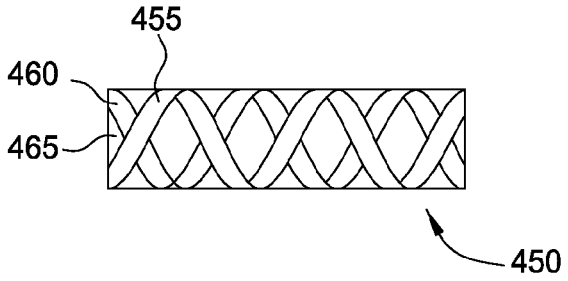
FIG. 14 is a view illustrating an anchor with a double helix band arrangement.

FIG. 14 is a view illustrating an anchor 450 with a double helix band arrangement. As shown, the anchor 450 includes a first band 455 and a second band 460 that are attached to a tubular 465 in a double helix manner. Each band 455, 460 may be one continuous piece or several individual pieces. The bands 455, 460 may include any number of connection points. Similar to other embodiments, the bands 455, 460 are configured to bow radially outward as the length of the tubular 465 shrinks during the expansion operation.

Figure 15A:
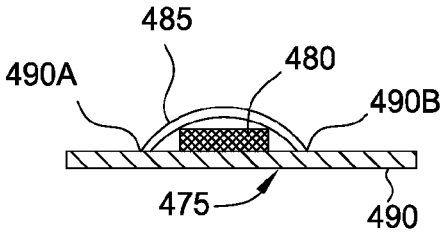
FIG. 15A is a view illustrating an anchor prior to expansion.
Figure 15B:
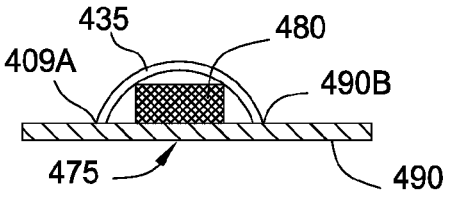
FIG. 15B is a view illustrating the anchor after expansion.

FIG. 15A is a view illustrating an anchor 475 prior to expansion, and FIG. 15B is a view illustrating the anchor 475 after expansion. The anchor 475 includes band 485, which is attached to a tubular 490 at connection points 490A, 490B. The anchor 475 further includes a biasing member 480 disposed between the band 485 and the tubular 490. The biasing member 480 may be an elastomer member, a swelling elastomer, a spring, Bellville washers, a shape memory polymer, a shape memory metal, one or more bands substantially aligned with the band 485 similar to bands 340, 345 as described in FIGS. 11A-11D or any other known biasing member. The biasing member 480 is configured to apply a radial force on an inner surface of the band 485, which may encourage the band 485 to bow radial outward during the expansion operation of the tubular 490. The biasing member 480 is movable from a compressed position (FIG. 15A) to a less compressed position (FIG. 15B). More specifically, the biasing member 480 is compressed and placed between the band 485 and the tubular 490 when the anchor 475 is fabricated. During the expansion operation of the anchor 475, the length of the tubular 490 shrinks, which causes the band 485 to bow radially outward. At the same time, the biasing member 480 applies a radial force on the inner surface of the band 485, which also causes the band to bow radially outward.

Figure 16A:
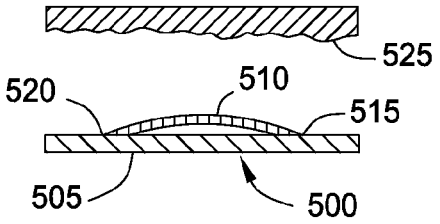
FIG. 16A illustrates a view of an anchor prior to expansion.

FIG. 16A illustrates a view of an anchor 500 prior to expansion. The anchor 500 includes a band 510, which may be made from thin strips of flexible material, such as metal or composite. The band 510 is attached to a tubular 505 at connection points 515, 520 along the longitudinal axis of the tubular 505. As will be discussed herein, the connection point 520 is a releasable connection that is configured to release the connection between the band 510 and the tubular 505 at a predetermined time.

Figure 16B:
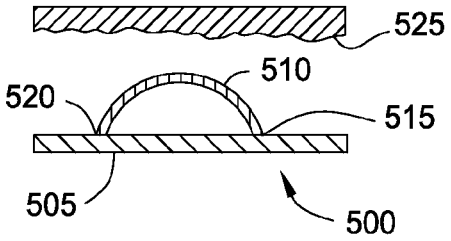
FIG. 16B illustrates a view of the anchor after expansion.

FIG. 16B illustrates a view of the anchor 500 after expansion. As shown, the band 485 is bowed radially outward. Similar to the other embodiments, the length of the tubular 490 shrinks during the expansion operation, which causes the band 485 to bow radially outward. As also shown in FIG. 16B, the band 510 is still connected to the tubular 510 at the connection points 515, 520.

Figure 16C:
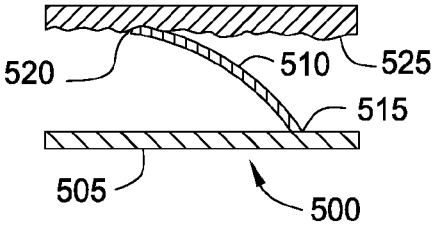
FIG. 16C illustrates a view of the anchor in contact with a borehole.

FIG. 16C illustrates a view of the anchor 500 in contact with a borehole 525. At a predetermined point, the connection point 520 is configured to release the connection between the band 510 and the tubular 505, which allows an end portion of the band 510 to move radially outward into contact with the borehole 525. In one embodiment, the connection point 520 releases due to a shear force that acts on the connection point 520 which is generated by the shrinkage of the tubular 505 upon expansion of the anchor 500. The connection point 520 may be formed using spot welding, glue, releasable screws, shear pins or any other temporary connection members known in the art. After the connection point 520 is released, the end portion of the band 510 pivots around the connection point 515 until the end portion contacts the borehole 525. The end portion may include gripping members or a coating that increases the friction between the end portion and the borehole 525. Although FIGS. 16A-16C illustrate one band 510, any number of bands may be used in the anchor 500 without departing from principles of the present invention. Additionally, the bands of the anchor 500 may be configured such that the release of the connection point may alternate with adjacent bands. In other words, the connection point 520 may release on one band and the connection point 515 may release the adjacent band. Further, another band may be located under the band 510 and include a releasable connection point that releases around the same time as the connection point 520 and thus resulting in two contact points with borehole 525. Furthermore, other bands as set forth in FIGS. 11A-11D or a biasing member as set forth in FIGS. 15A-15B may be placed under the band 510 to encourage engagement of the band 485 with the borehole 525.

While the foregoing is directed to embodiments of the present invention, other and further embodiments of the invention may be devised without departing from the basic scope thereof, and the scope thereof is determined by the claims that follow.

The invention claimed is:

1. An anchoring device comprising:

an expandable tubular; and a plurality of bands disposed on an outer surface of the expandable tubular, each band being attached to the tubular at a first connection point and a second connection point, wherein each band is configured to bow radially outward as the expandable tubular shortens in length in response to the expansion of the tubular, and wherein a first set of the plurality of bands has a length different than a length of a second set of the plurality of bands.

2. The anchoring device of claim 1, wherein the first and second connection points move closer together as the length of the expandable tubular moves from a first length to a second shorter length.

3. The anchoring device of claim 1, wherein a distance between the first connection point and the second connection point defines the length of each band.

4. The anchoring device of claim 3, wherein the amount of radial expansion of each band is proportional to the length of the band.

5. The anchoring device of claim 3, wherein the strength of each band is inversely proportional to the length of each band.

6. The anchoring device of claim 1, wherein the band is disposed on a reduced diameter portion of the tubular.

7. The anchoring device of claim 1, wherein each band has a longitudinal axis that is rotated relative to a longitudinal axis of the expandable tubular.

8. The anchoring device of claim 1, further including an expansion member attached to the expandable tubular which is configured to expand axially as the expandable tubular expands radially.

9. The anchoring device of claim 1, wherein the expandable tubular includes a substantially uniform inner diameter.

10. The anchoring device of claim 1, further including a seal member disposed on the expandable tubular.

11. The anchoring device of claim 1, as the expandable tubular shortens in length in response to the expansion of the tubular, the first set of bands is expanded to a first radial diameter and the second set of bands is expanded to a second radial diameter different than the first radial diameter.

12. A method of attaching an anchoring device in a borehole, the method comprising:

positioning the anchoring device in the borehole, the anchoring device having a tubular and a plurality of bands disposed on an outer surface the tubular, wherein a first set of the plurality of bands has a length different than a length of a second set of the plurality of bands; and reducing the axial length of the tubular by expanding the tubular radially outward, wherein the reduction of axial length of the tubular causes the plurality of bands to bow radially outward into contact with the borehole.

13. The method of claim 12, wherein each band is attached to the tubular at a first connection point and a second connection point and wherein the connection points move closer together as the axial length of the tubular is reduced.

14. The method of claim 12, wherein each band buckles to contact the borehole at a first contact point and a second contact point.

15. The method of claim 12, wherein each band is misaligned with respect to a longitudinal axis of the tubular.

16. The method of claim 12, further including gripping the borehole with an outer surface of the bands.

17. The method of claim 12, wherein reducing the axial length of the tubular comprises expanding the first set of the plurality of bands to a first radial diameter and expanding the second set of the plurality of bands to a second radial diameter different than the first radial diameter.

* * * * *